United States Patent [19]

Goetz et al.

[11] Patent Number: 4,843,835

[45] Date of Patent: Jul. 4, 1989

[54] REFRIGERATOR DRAIN FUNNEL

[75] Inventors: Glenn E. Goetz, Amana; Jeffrey L. Prunty, Swisher; Ramon L. Klemmensen, Cedar Rapids, all of Iowa

[73] Assignee: Amana Refrigeration, Inc., Amana, Iowa

[21] Appl. No.: 250,027

[22] Filed: Sep. 27, 1988

[51] Int. Cl.[4] ..... F25D 21/14

[52] U.S. Cl. ..... 62/285; 62/288; 62/291

[58] Field of Search ..... 62/285, 288, 289, 290, 62/291

[56] References Cited

U.S. PATENT DOCUMENTS

| | | | |
|---|---|---|---|
| 3,120,111 | 2/1964 | Simmons | 62/288 X |
| 3,404,540 | 10/1968 | Bryans et al. | 62/285 |
| 3,696,632 | 10/1972 | Carlin et al. | 62/291 X |
| 3,774,408 | 11/1973 | Pruehs | 62/288 X |

*Primary Examiner*—Lloyd L. King

*Attorney, Agent, or Firm*—William R. Clark; Richard M. Sharkansky

[57] ABSTRACT

A rigid plastic twist lock drain funnel for conveying defrost water from the interior of the refrigerator cabinet, through the insulation space, to the exterior. A top portion of the funnel has a groove seating an O-ring, and a central portion has a pair of radially extending cam-shaped ears. During fabrication, the drain funnel is inserted from inside the refrigerator liner through an aperture having notches for receiving the ears, and then the funnel is twisted approximately 90° to engage the ears as a cam lock. In such arrangement, the funnel is securely attached to the liner and the O-ring provides a seal therebetween so as to prevent subsequently injected foam insulation from leaking to the interior of the cabinet. To allow for misalignment between the linear and the outer case, the opposite end of the drain funnel passes through an oversized hole in the outer case of the refrigerator. A spongy gasket around the lower end of the funnel is compressed between a shoulder of the funnel and the outer case so as to provide a seal therebetween.

17 Claims, 2 Drawing Sheets

FIG. 1
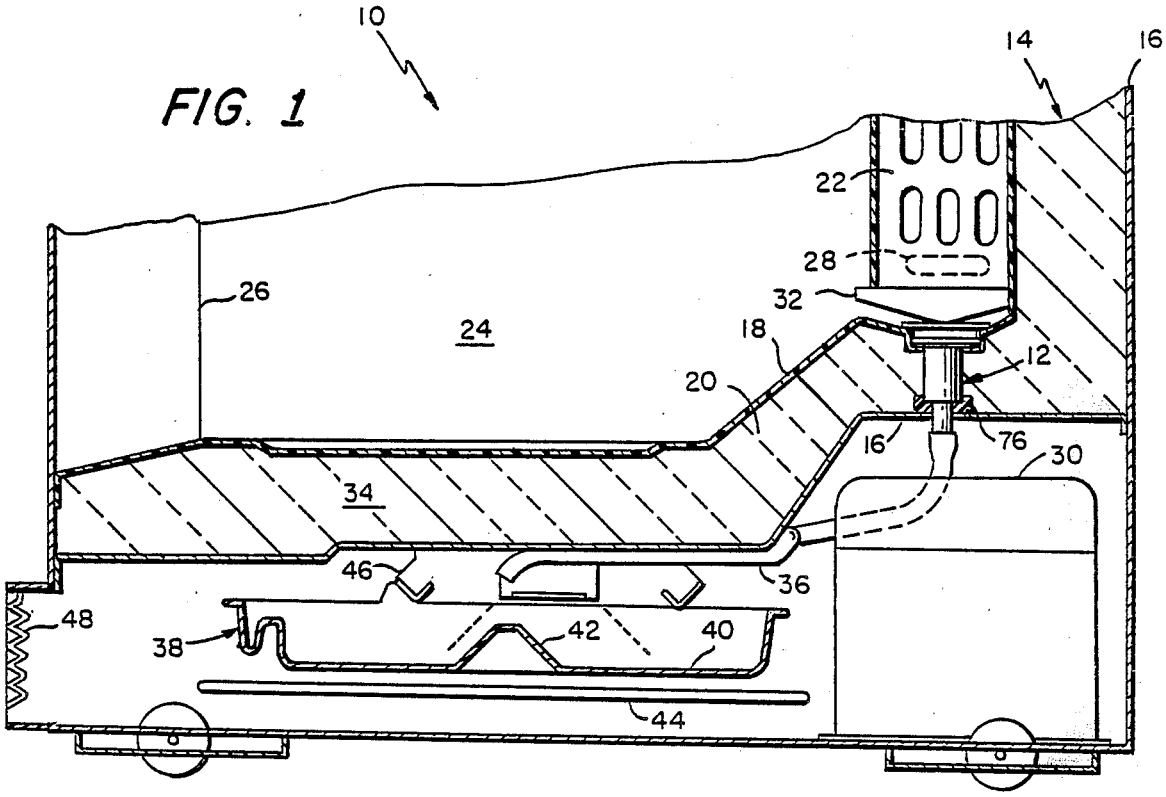
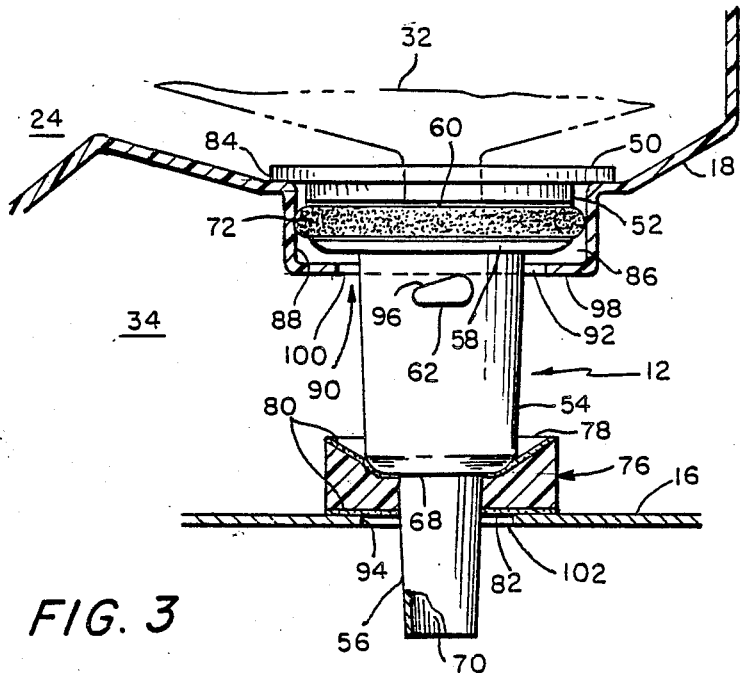
FIG. 3

REFRIGERATOR DRAIN FUNNEL

BACKGROUND OF THE INVENTION

The field of the invention relates to foam insulated refrigerators, and more particularly relates to apparatus for draining water from a defrosting evaporator through the insulation space between the liner and the outer casing, and the method of fabricating such apparatus.

As is well known, most domestic refrigerators are insulated using a so-called foam-in-place process. That is, a plastic liner is positioned within the outer metal shell or casing with a space between the liner and the shell. Foam insulation is then injected under pressure into the space between the liner and the shell, and the foam flows along the bottom, sides, and top so as to fill all voids in the space. Subsequently, the foam solidifies and becomes rigid insulation.

When a defrost refrigerator is foamed-in-place, a small passageway is provided through the insulation space so that when ice is melted from the evaporator, the water can drain from the evaporator through the insulation to a drain pan underneath the refrigerator. There are a number of design criteria placed on a conduit which channels the defrost water through the insulation space. First, because it is preferable to install it before foaming, it must withstand the temperature and pressure of the foam injection process without collapsing or leaking foam. Also, because of manufacturing tolerances, it must allow for misalignment between an aperture in the liner and a corresponding hole in the shell. Further, it must seal to the liner during the foam injecting process and thereafter provide a watertight seal so that water within the liner cannot leak into the cabinet insulation. Also, it must seal to the shell during the foam injecting process and thereafter provide an airtight seal to prevent water vapor from entering the insulation from the outside.

Generally, prior art conduits or drain funnels have been made from either flexible rubber or rigid injection molded plastic. A rubber conduit seals to the liner and shell like a grommet, and its inherent flexibility allows for cabinet misalignment. However, because it is flexible, the pressure of the foam tends to collapse a rubber conduit unless a temporary plug is inserted through the conduit before the foam is injected. Inserting and removing a plug means extra steps in the fabrication process, and occasionally a plug may be forgotten and left in the conduit thereby requiring a subsequent service call when the defrost drain clogs during operation. Also, because rubber conduits have been relatively large so that the temporary plugs can easily be inserted and removed, screens have been used to cover the large drain openings so that debris will not drop into the rubber conduits thereby clogging them; the screens increase labor and parts costs. Another drawback of rubber conduits is that they are more expensive than rigid injection-molded plastic parts.

Rigid injection-molded plastic funnels or conduits stand up to foam pressure without internal reinforcement such as provided by a temporary plug. However, problems occur in sealing and also in allowing for misalignment between the liner and the shell. One prior art approach is to hand caulk the funnel and then seal it to the liner. This approach requires constant attention of the assembly operator to ensure that there is a good seal around the entire perimeter of the funnel. In a small but very expensive percentage of these caulk seals, foam leaks into the drain funnel. These leaks require an expensive procedure of turning the cabinet over, digging out the funnel, cleaning it, and then resealing it. Also, since the new funnel is not foamed-in-place, it may not have a good seal to the liner. Furthermore, spring fixtures have been used to hold rigid plastic funnels in place until after foaming. Sometimes, these spring fixtures become unhooked and fall out of place during foaming thereby resulting in foam leaks. Also, the use of a spring fixture requires extra parts and steps during the manufacturing process, and after removed, the spring fixtures have to be carried back to an earlier station on the assembly line.

Another prior art rigid plastic approach uses screws to clamp a gasket between the funnel flange and the liner. This makes leaks unlikely and holds the funnel in place without the use of a spring fixture, but it makes misalignment of the liner and the shell a greater problem. One approach to this misalignment has been to have an oversized hole in the shell, and then use a plug button to cover the gap between the funnel and the perimeter of the hole. Specifically, the plug button has a hole in the center sized to fit the drain funnel end. To allow for misalignment, the hole is slit so that the drain funnel can exit the hole off center. After installing the funnel and plug button, hand-applied sealer is used to close the slit. This technique also requires close operator attention, and a certain percentage of such seals have developed leaks which are expensive to repair.

SUMMARY OF THE INVENTION

An object of the invention is to provide a drain funnel or conduit that can easily and reliably be installed before foaming-in-place.

It is also an object to provide a drain funnel that can withstand the foam pressure without internal reinforcement. In other words, it is an object that the drain funnel be rigid enough so that it doesn't collapse when subjected to foam pressure.

It is a further object to provide a drain funnel that effectively seals to the liner and to the shell so as to prevent foam leaks during the process of foaming-in-place, and thereafter provides a watertight seal to the liner and a vapor tight seal to the shell.

It is also an object to provide a drain funnel that can be easily inserted to span between an aperture in the liner and a corresponding hole in the shell even though these respective opening may be misaligned due to manufacturing tolerances.

It is a further object to provide a twist lock drain funnel that can readily and reliably be installed in a single step without plugs, supporting structure or subsequent sealing steps.

In accordance with the invention, drain pan apparatus is provided and is adapted for connecting between the aperture in the liner and the hole in the outer casing before foaming-in-place. The apparatus comprises a rigid plastic conduit, means for twist-locking the conduit to the aperture in the liner, means for sealing the conduit to the liner for preventing insulation foam under pressure from leaking through the aperture, and means for sealing the conduit to the outer casing for preventing insulation foam under pressure from leaking through the hole. Subsequently, the space between the liner and the outer casing is foamed-in-place and the conduit provides a passageway through the insulation for draining defrost water from the evaporator to a drain pan below the cabinet. Preferably, the twist-lock means comprises a pair of cam-shaped ears which are integrally molded to the conduit and are received by corresponding notches in the aperture before twist-locking the conduit in place. The liner sealing means may preferably comprise an O-ring which is compressed between an upper portion of the conduit and the liner. Further, it may be preferable that the conduit have a lower portion with a diameter smaller than a central portion of the conduit thereby defining a downwardly facing shoulder of the central portion. The outer casing sealing means may then comprise a flexible gasket which is compressed between the shoulder and the outer casing thereby enabling an oversized hole to be used so that the hole need not be perfectly aligned with the aperture. The upper portion of the conduit may also include radial wings used to apply manual torque for twist-locking the conduit.

The invention may also be practiced by the method of fabricating a refrigerator cabinet comprising the steps of providing an outer casing having a hole, providing an inner liner having an aperture, positioning the liner in spaced relationship within the outer casing wherein the aperture is approximately aligned with the hole, inserting a rigid plastic conduit spanning between the aperture in the liner and the hole in the outer casing, twist-locking the conduit in place with respective ends of the conduit sealing to the liner and the casing, and injecting foam insulation under pressure into the space between the liner and the outer casing. Preferably, the twist-locking is provided by having a pair of ears on the conduit which are inserted through corresponding notches in the aperture, which ears are then twisted away from the notches to securely engage the conduit to the liner.

BRIEF DESCRIPTION OF THE DRAWINGS

The foregoing objects and advantages will be more fully understood by reading the Description of the Preferred Embodiment with reference to the drawings wherein:

FIG. 1 is a sectional view of the lower portion of a refrigerator;

FIG. 3 is a side view of the drain funnel secured in place between the liner and shell.

DESCRIPTION OF THE PREFERRED EMBODIMENT

Figure 2:
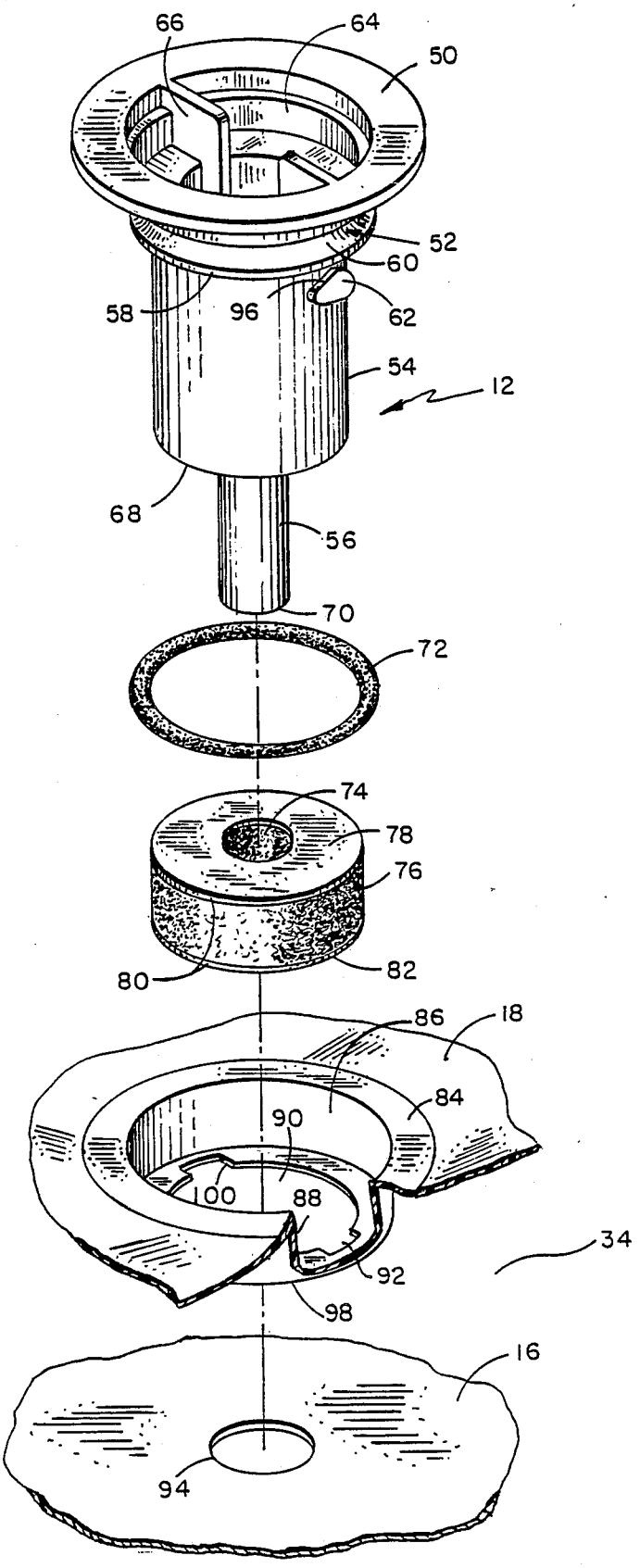
FIG. 2 is an exploded view of the drain funnel and portions of the liner and shell.

With reference to the drawings wherein like reference numerals refer to like parts throughout the several views, a rigid plastic conduit or drain funnel 12 is used to convey defrost water from the interior of cabinet 14 through the foam insulation 20 to the exterior where it drains into drain pan 38. The funnel or conduit 12 includes an O-ring 72, a pair of cam locks or ears 62, and a cylindrical gasket 76. The conduit 12 is mounted in place before the insulation space 34 between the liner 18 and the shell 16 is foamed-in-place. Conduit 12 is installed from inside liner 18 by inserting it through aperture 90 with ears 62 passing through notches 92, and then twist-locking conduit 12 by rotating it so that ears 96 engage and clamp peripheral portions of aperture 90 on the underside of liner 18. O-ring 72 seals conduit 12 to liner 18. The lower portion 56 of conduit 12 extends through oversized hole 94 in shell 16, and gasket 76 is compressed between shoulder 68 and outer casing 16 thereby sealing conduit 12 to peripheral portions of outer casing 16 around hole 94.

Referring to FIG. 1, a sectioned view of the bottom portion of refrigerator 10 shows drain funnel or conduit 12 in its mounted operating position. The cabinet 14 of refrigerator 10 includes a metal shell 16 or outer casing and an inner plastic liner 18 with foam insulation 20 therebetween. Evaporator 22 is located inside cabinet 14 in compartment 24 which is accessed through door 26. Although evaporator 22 is here shown at the bottom of refrigerator 10 such as would commonly be the location for an evaporator when the freezer compartment is located at the bottom, the invention would have similar advantage with a refrigerator having the evaporator 22 mounted at the top such as would be common for a top-mount refrigerator. As is conventional, evaporator 22 is periodically defrosted by energizing heating coil 28 while compressor 30 is deactivated. Such defrosting melts ice or frost that is formed on evaporator 22 thereby improving thermal transfer to evaporator 22. The water resulting from the melting drips into collector 32 and is then conveyed through insulation space 34 between plastic liner 18 and metal shell 16 via drain funnel or conduit 12. A tube 36 or hose then carries the water to drain pan 38 from which it evaporates. The bottom 40 of drain pan 38 here has a mound 42 positioned below the exit of tube 36 so that the water drips onto mound 42 and runs into the accumulated water rather than dripping directly into the water and causing a water dripping noise. Drain pan 38 is supported above condenser 44 by brackets 46 which permit drain pan 38 to be slid out when grill 48 is removed.

Referring to FIG. 2, an exploded view of conduit 12 is shown positioned above broken-away portions of liner 18 and outer case or shell 16. Conduit 12, which is a rigid plastic part such as manufactured by injection molding, includes a top portion 52, a central portion 54 and a lower portion 56. Top portion 52 includes a top flange 50 and a molded annular ring 58 which forms an O-ring channel 60 or groove. Top portion 52 of conduit 12 also includes an internal cavity 64 of relatively large diameter with a pair of opposed inwardly-extending radial wings 66 which, as will be described later, provide surfaces for manually exerting torque to rotate conduit 12 and thereby twist-lock it to liner 18. Central portion 54 has a slight inward taper in the downward direction, but is a generally cylindrical segment having a pair of molded cam-shaped ears 62 on opposite sides. As will be described, ears 62 provide twist cam locks. Lower portion 56, which also has a slight inward taper, has a smaller diameter than central portion 54 thereby defining a bottom surface or shoulder 68 on the lower end of central portion 54. As an example, the outer diameter of lower portion 56 may be 0.5 inches, while the outer diameter of central portion 54 may be 1.0 inches. An inside axial bore 70 runs the entire internal length of conduit 12 or drain funnel.

In fabrication, O-ring 72 which may, for example, have an outer diameter of 1.75 inches, is stretched over annular ring 58 and seated in O-ring channel 60. Next, lower portion 56 of conduit 12 is inserted in bore 74 of cylindrical gasket 76 which is then pushed upwardly until the upper surface 78 engages the shoulder 68 of central portion 54. The diameter of lower portion 56 is such that gasket 76 is held in an interference fit. Gasket 76 is resilient or spongy and preferably is a closed-cell material such as, for example, polyethylene foam. In order to make an airtight seal as will be described later herein, gasket 76 has an airtight sealing membrane 80 on its upper and lower surfaces 78 and 82. The outer diameter of gasket 76 may, for example, be approximately 1.5 inches.

Liner 18, which is a conventional plastic material such as, for example, ABS, has an annular planar region 84 surrounding a cylindrical hollow or recess 86 which has a cylindrical wall 88 and a bottom aperture 90 having a pair of opposing twist lock notches 92 adapted to receive the ears 62 of conduit 12. Shell 16 is shown in spaced relationship to liner 18 with insulation space 34 therebetween. Hole 94 in shell 16 is approximately positioned below aperture 90.

On the assembly line, shells 16 or outer casings are supported on their backs and move along a conveyor. A liner 18 is lowered into each shell 16 and the edges are mated so that the liner 18 is supported in spaced relationship to the shell 16 thereby defining an insulation space 34 between them. Hole 94 in shell 16 generally aligns with aperture 90 of liner 18, but because of manufacturing tolerances, there normally is some misalignment of aperture 90 in the directions from front-to-back, side-to-side, and top to bottom.

Conduit 12 with O-ring 72 seated in O-ring channel 60 and gasket 76 surrounding lower portion 56 is then inserted from inside liner 18 through aperture 90. Aperture 90 may preferably be smaller than gasket 76. For example, gasket 76 may have an outer diameter of 1.5 inches, and the aperture may have a diameter of approximately 1.15 inches with notches 92 extending approximately 0.2 inches more. However, due to the flexible or spongy characteristic of gasket 76, a skilled assembly worker can easily and readily insert the end of lower portion 56 into aperture 90, tip conduit 12 with gasket 76 aligning with notches 92, and then push gasket 76 through aperture 90 with a forward and backward motion and a slight twist. Then, once gasket 76 has passed through aperture 90, conduit 12 is inserted further through aperture 90 such that ears 62 pass through notches 92 of aperture 90. If the ears 62 are not aligned with notches 92, they will not pass through aperture 90 because their outer diameter is greater than the inner circular portion of aperture 90. The operator then engages wings 66 with his fingers and gives conduit 12 an approximately 90° twist. Ears 62 are cam-shaped and have a sloped surface 96 which engages the underside 98 of liner 18 at the sides 100 of notches 92. As conduit 12 is initially twisted, the point of contact between ears 62 and the sides 100 of notches 92 moves up sloped surfaces 96 so that the drain funnel or conduit 12 is drawn tighter against liner 18. In other words, cam-shaped ears 62 provide a twist lock which clamps conduit 12 securely against liner 18.

Referring to FIG. 3, conduit 12 is shown locked in place. Flange 50 seats down against region 84 and O-ring 72 is compressed between channel 60 and cylindrical wall 88 thereby providing a seal between conduit 12 and liner 18. In the operational mounted position as shown in FIG. 3, the drain end of lower portion 56 of conduit 12 extends downwardly through hole 94 in shell 16. As described earlier, there may be misalignment between aperture 90 and hole 94, so hole 94 is oversized so that the drain end of lower portion 56 can extend through even when it is off center. That is, hole 94 is larger than the outer diameter of lower portion 56. For example, hole 94 may have a diameter of approximately one inch as compared to lower portion 56 having an outer diameter of 0.5 inches. Gasket 76 seals the gap 102 between lower portion 56 and the perimeter of hole 94. The maximum spacing between the bottom surface or shoulder 68 of central portion 54 and shell 16 is less than the height of gasket 76 such that when conduit 12 is twist-locked in place as shown in FIG. 3, gasket 76 is compressed between shoulder 68 and peripheral portions of hole 94 thereby forming a seal between conduit 12 and shell 16. For example, gasket 76 may have a height of approximately 0.5 inches. Airtight membranes 80 on both upper and lower surfaces 78 and 82 of gasket 76 seat and seal, respectively, against shoulder 68 of conduit 12 and the shell perimeter around hole 94.

In accordance with the invention, O-ring 72 provides a seal between conduit 12 and liner 18 such that when foam under pressure is subsequently injected into space 34, the foam is prevented from leaking around O-ring 72 into the interior of liner 18. Also, O-ring 72 provides a watertight seal so that during subsequent refrigerator operation, water cannot leak from the interior of liner 18 into the insulation space 34 through aperture 90. Further, gasket 76, which is compressed between shoulder 68 and shell 16, provides a seal that prevents foam from leaking through hole 94 during the foam injection process. Also, during refrigerator operation, gasket 76 provides an airtight seal to prevent water vapor from entering insulation 20 through hole 94.

As described earlier, foam insulation 20 is injected into insulation space 34 subsequent to the installation of conduit 12 as shown in FIG. 3. Accordingly, conduit 12 is easily and readily installed in a single assembly line step before foaming-in-place, and it reliably self-seals to the liner 18 and the shell 16 thereby preventing the foam from leaking out either aperture 90 or hole 94. Further, conduit 12 is rigid plastic so that it does not need a plug or similar internal reinforcement to withstand collapsing under the pressure of the foam. The arrangement of gasket 76 permits conduit 12 to be used with an oversized hole 94 in shell 16 thereby enabling easy installation even though there may be misalignment between hole 94 and aperture 90 in any or all of three dimensions. During fabrication, tube 36 is inserted over the drain end of lower portion 56 of conduit 12 thereby completing the path for the defrost water to drain pan 38.

This completes the Description of the Preferred Embodiment. However, the reading of it by one skilled in the art will bring to mind various alterations or modifications within the spirit and scope of the invention. Accordingly, it is intended that the scope of the invention be limited only by the appended claims.

What is claimed is:

1. Refrigerator drain apparatus adapted for being connected between an aperture in the liner and a hole in the outer casing before foaming-in-place and subsequently providing a passageway through the insulation for draining defrost water, said apparatus comprising:

a rigid plastic conduit;

means for twist-locking said conduit to said aperture in said liner;

means for sealing said conduit to said liner for preventing insulation foam under pressure from leaking through said aperture; and means for sealing said conduit to said outer casing for preventing insulation foam under pressure from leaking through said hole.

2. The apparatus recited in claim 1 wherein said twist-lock means comprises at least a pair of cam-shaped ears integrally molded to said conduit.

3. The apparatus recited in claim 1 wherein said liner sealing means comprises an O-ring.

4. The apparatus recited in claim 1 wherein said conduit has a lower portion having a diameter smaller than a central portion defining a downwardly-facing shoulder, and said outer casing sealing means comprises a flexible gasket compressed between said shoulder and said outer casing.

5. Apparatus adapted for twist-locking in place between a notched aperture in the liner and a hole in the outer casing of a refrigerator before foaming-in-place and subsequently providing a passageway for defrost water to drain through the insulation space between the liner and the outer casing, said apparatus comprising:

a rigid plastic conduit having an upper portion, a central portion having a downwardly-facing shoulder, and a lower portion;

said central portion having at least one ear adapted for inserting through a notch of said notched aperture and twist-locking said conduit to said liner after rotation underneath peripheral portions of said aperture; and a gasket surrounding said lower portion of said conduit and seated against said shoulder wherein, after twist-locking said conduit in place, said gasket is compressed between said shoulder and peripheral portions of said hole thereby providing a seal between said conduit and said outer casing to prevent injected foam from leaking therebetween.

6. The apparatus recited in claim 5 further comprising an O-ring engaged between said upper portion of said conduit and peripheral portions of said aperture thereby providing a seal between said conduit and said liner to prevent injected foam from leaking therebetween.

7. The apparatus recited in claim 5 wherein said upper portion comprises wings for manually twisting said conduit to rotate said at least one ear underneath peripheral portions of said aperture.

8. The apparatus recited in claim 5 wherein said central and lower portions of said conduit are inwardly tapered in a downward direction.

9. The apparatus recited in claim 5 wherein said upper portion of said conduit comprises a channel for seating said O-ring.

10. The method of fabricating a refrigerator cabinet, comprising the steps of:

providing an outer casing having a hole;

providing an inner liner having an aperture;

positioning said liner in spaced relationship within said outer casing with said aperture approximately aligned with said hole in said outer casing;

inserting a rigid plastic conduit spanning between said aperture in said liner and said hole in said outer casing;

twist-locking said conduit in place with respective ends of said conduit sealing to said liner and said casing; and injecting foam insulation under pressure into the space between said liner and said outer casing.

11. The method recited in claim 10 wherein an O-ring seals one end of said conduit to said liner.

12. The method recited in claim 10 wherein said conduit has a shoulder and said conduit is sealed to said outer casing by a gasket compressed between said shoulder and said outer casing.

13. The method recited in claim 10 wherein said conduit is twist-locked in place by a pair of cam-shaped ears that pass through corresponding notches in said aperture, said ears rotating under peripheral portions of said aperture when said conduit is twisted so as to provide said twist-locking.

14. The method of manufacturing a refrigerator cabinet, comprising the steps of:

providing an outer casing having a hole;

providing an inner liner having an aperture with at least one twist-lock notch;

providing a rigid plastic conduit having an upper portion, a central portion, and a lower portion, said central portion having a downwardly facing shoulder and at least one twist-lock ear;

positioning an annular gasket around said lower portion of said conduit;

positioning said inner liner in spaced relationship within said outer casing with said aperture approximately aligning with said hole in said outer casing;

inserting said rigid plastic conduit through said aperture so that said twist-lock ear passes through said twist-lock notch and said lower portion extends through said hole, said gasket being compressed between said shoulder and said outer casing;

twisting said conduit so that said ear rotates away from said notch and engages peripheral portions of said aperture thereby twist-locking said conduit to said liner; and injecting foam insulation into the space between said liner and said outer casing.

15. The method recited in claim 14 wherein an O-ring seals said upper portion of said conduit to the upper side of said liner.

16. The method recited in claim 14 wherein said upper portion of said conduit comprises a pair of wings for manually applying torque to twist said conduit.

17. The method recited in claim 14 wherein said central portion of said conduit has a pair of cam-shaped twist-lock ears.

* * * * *